United States Patent [19]

Sato

[11] 4,136,811

[45] Jan. 30, 1979

[54] H-SHAPED STEEL COLUMN BASE MEMBER AND WELDING THEREOF

[75] Inventor: Kuniaki Sato, Hiratsuka, Japan

[73] Assignee: Kajima Corporation, Tokyo, Japan

[21] Appl. No.: 847,266

[22] Filed: Oct. 31, 1977

Related U.S. Application Data

[60] Division of Ser. No. 613,347, Sep. 15, 1975, Pat. No. 4,068,436, which is a continuation-in-part of Ser. No. 385,166, Aug. 2, 1973, Pat. No. 4,048,776.

[30] Foreign Application Priority Data

Aug. 21, 1972 [JP] Japan ..... 47/82799
Aug. 21, 1972 [JP] Japan ..... 47/82800

[51] Int. Cl.[2] ..... B23K 31/02

[52] U.S. Cl. ..... 228/165; 52/296; 228/178; 403/271

[58] Field of Search ..... 228/165, 169, 178, 168, 228/175; 403/271; 52/292, 296, 297, 298; 29/155 C

[56] References Cited

U.S. PATENT DOCUMENTS

| | | | |
|---|---|---|---|
| 950,806 | 3/1910 | Richardson | 52/301 |
| 1,258,409 | 3/1918 | Hill | 248/357 |
| 1,887,399 | 11/1932 | Costello | 52/292 X |
| 2,867,036 | 1/1959 | Hovelmann | 228/165 |
| 4,048,776 | 9/1977 | Sato | 52/297 |

*Primary Examiner*—Al Lawrence Smith
*Assistant Examiner*—K. J. Ramsey

[57] ABSTRACT

A steel column base member for connecting an H-shaped structural steel column member to a concrete foundation, which base plate member is an integral cast or forged body comprising a bottom plate member to engage the foundation, an H-shaped projection upwardly extending from the bottom plate member and having J-shaped grooves formed along both edges of top surface of projection the width of web of projection being broader than that of web of column member, so as to effect groove welding between the bottom surface of the steel column member and the J-shaped grooved surfaces, and fillet welding both side of web of the column member and base plate member. A method of connecting an H-shaped steel column member to a base plate member is characterized by, effecting fillet welding along between lower ends of a web of column member and a top surface of base plate member, effecting J-shaped groove welding along betweeen J-shaped groove surfaces of base plate member and the bottom surfaces of flanges of steel column member, and fillet welding along between the inner lower ends of flanges of a steel column member and the top surfaces of flanges of projection.

3 Claims, 11 Drawing Figures

H-SHAPED STEEL COLUMN BASE MEMBER AND WELDING THEREOF

BACKGROUND OF THE INVENTION

Field of the Invention

This is a division of application Ser. No. 613,347, filed Sept. 15, 1975, now U.S. Pat. No. 4,068,436, which is a continuation-in-part of application Ser. No. 385,166, filed Aug. 2, 1973, now U.S. Pat. No. 4,048,776.

This invention relates to a steel column base plate member for connecting an H-shaped steel column member of a steel structure to concrete foundation therefor.

Description of the Prior Art

Steel column members of architectural buildings or construction structures are connected to concrete foundations, by means of base plates. It is well known that the steel column is stronger than the concrete of the foundation by a factor of not smaller than 10. To compensate for such difference of the strength between the concrete of the foundation and the steel column, the lower end of the column is joined to a steel plate, and the base plate is secured to the concrete foundation by means of anchor bolts embedded in the concrete foundation.

It has been suggested to provide a base for a column having a recess adapted to accommodate the lower end of the column as shown in U.S. Pat. No. 134,269 issued to J. Gray on Dec. 24, 1872. This base is formed at its center with the recess to reduce its thickness at the center so that the strength against a vertical force may become insufficient to support a load.

It has also been suggested to fit a foot within a lower end of a column which is then inserted into a bed plate with a sleeve or socket to bring the foot into contact with the bed-plate, disclosed for example as in U.S. Pat. No. 198,072 issued to A. Bonzano on Dec. 11, 1877. This bed-plate will support a vertical force but insufficient to support a bending moment transmitted from the column which will probably been supported by the sleeve.

It has also been suggested to provide a base-socket having a supporting base member and an upwardly projecting portion containing a recess to receive the lower end of a column which is secured within the socket by riveting or the like. Such a socket has been disclosed in the U.S. Pat. No. 1,258,409 issued to T. Hill on Mar. 5, 1918. However, the socket has a configuration prone to give rise to a stress concentration and fails in smooth stress transmission through the socket from the column to a concrete foundation.

Generally speaking, the base plate member is required to fulfill the following conditions.

(1) Since the base plate will be subjected to various severe forces resulting from axial force, shearing force and bending moment acting upon the column member, the base plate must be in a configuration to avoid any stress concentration and perform a smooth stress transmission from the column member to the foundation.

(2) In order to decrease the cost of a construction as a whole, the working of column member should be minimized only to cutting of both ends thereof. If any grooves for welding are required, the base plate member should be formed with such grooves by the use of means of minimum possible cost.

(3) If utilizing any welding method for connecting the base plate member to a column member, the base plate member should be of a configuration capable of applying the most effective welding method which is higher in reliability, minimum of consumed welding rods and carried out with ease. The configuration is also applicable of a combination of welding methods of which characteristics help each other to accomplish the most rational arrangement which meets stresses derived from forces and bending moments to which the column member is subjected.

(4) The base plate member should be a configuration in agreement with a stress distribution acting thereupon resulting from axial and shearing forces and bending moment to which the column member is subjected.

(5) The base plate member should be such a configuration that a base portion of the base plate member in contact with a concrete foundation will not be affected by heating derived from welding of the plate member with the column member.

(6) The base plate member should be economical of manufacture and serve to decrease the cost of a construction as a whole

SUMMARY OF THE INVENTION

Accordingly, it is an object of the present invention to provide a steel column base plate member for connecting an H-shaped steel column member to a concrete foundation which overcomes the above disadvantages in the prior art and fulfills the above requirements for this kind of the base plate.

It is another object of the invention to provide a steel column base plate member, which has a novel configuration to avoid any stress concentration to perform a smooth stress transmission from a column member to a foundation and to make it possible to perform a combination of J-shaped groove welding between both flanges of column and base plate and fillet welding between both webs of column and base plate adapted to meet stresses acting upon the base plate.

It is further object of the present invention is to provide a novel base plate member, which is formed by casting or forging in a unitary body with grooves formed on the top surface of projections for effecting the J-shaped groove welding and has a configuration in agreement with a stress distribution acting thereupon and adapted not to be subjected to a detrimental effect of welding heating with the surface in contact with the foundation.

It is still more object of the invention to provide a base plate member for connecting an H-shaped steel column member to a concrete foundation, which is inexpensive of manufacture and serves to decrease the total cost of a construction.

In one aspect, the invention provides a base plate member for connecting an H-shaped steel column member to a concrete foundation, which base plate member is a unitary body comprising a substantially planar bottom plate portion engageable with said concrete foundation, a projection upwardly extending from the planar bottom plate portion and having a top surface whose shape is substantially identical to cross sectional shape of the steel column member, a web part of a top surface of said projection in opposition to a web of said column member havin a width broader than that of said web of the column member so as to effect sufficient fillet welding therewith, J-shaped welding grooves formed along both edges of said top surface of said projection facing to lower ends of flanges of said column member extending from outer peripheries of the top surface of said projection so as to effect J-shaped groove welding between said lower ends of the flanges and the J-shaped welding grooves, a sloped top surface formed between said projection to said bottom plate portion so as to increase the thickness thereof as the planar bottom plate portion extends toward said projection, and abutments formed on the planar bottom portion in a sufficient thickness and having anchor bolt holes bored therethrough.

In another aspect, the invention provides a method of connecting an H-shaped steel column member to a base plate member, wherein said base plate member comprises a substantially planar bottom plate portion, a projection extending from the planar bottom plate portion and having a top surface whose shape is substantially identical to cross sectional shape of the steel column member, a web part of a top surface of said projection having a width broader than that of a web column member, J-shaped welding grooves formed along both edges of said top surface of said projection facing to lower ends of flanges of said column member, the improvement characterized by, the steps of placing the lower end surface of said column member onto said top surface of said base plate member in a desired relation, effecting fillet welding along between lower ends of said web of the column member and said top surface of said base plate member, and effecting J-shaped groove welding along said J-shaped grooves of said base plate member between bottom surfaces of said flanges of the column member and said grooved surfaces of said base plate member.

BRIEF DESCRIPTION OF THE DRAWING

For a better understanding of the invention, reference is made to the accompanying drawing, in which.

DESCRIPTION OF THE PREFERRED EMBODIMENTS

Figure 1:
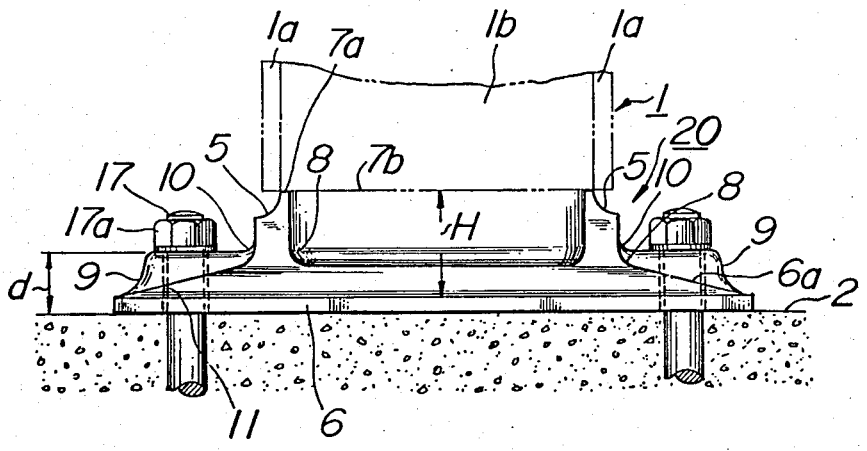
FIG. 1 is an elevation of a steel column base plate member for supporting an H-shaped column member, according to the invention.
Figure 2:
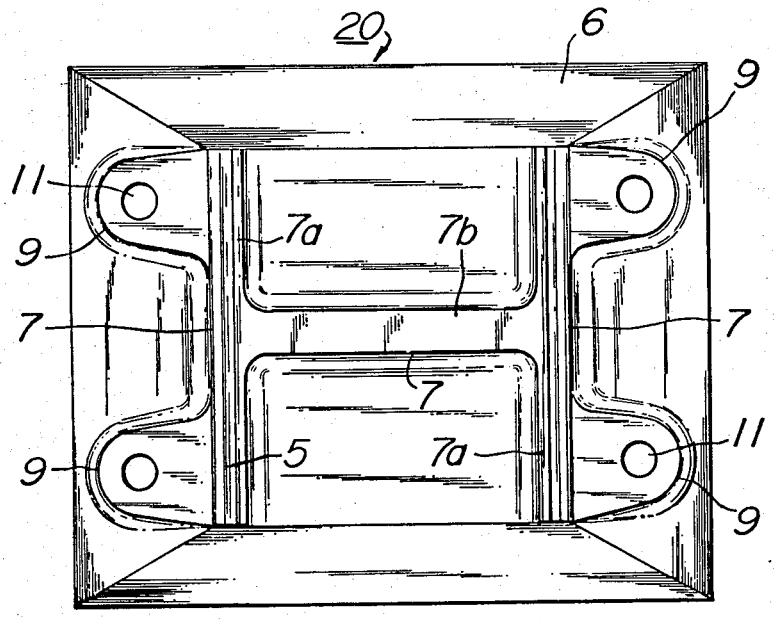
FIG. 2 is a plan view of the base plate member of FIG. 1.

Referring to FIGS. 1 and 2, a steel column base plate member 20 according to the present invention is to join an H-shaped steel column member 1 to a concrete foundation 2. The base plate member 20 itself is secured to the concrete foundation 2 by anchor bolts 17 and nuts 17*a*.

The base plate member 20 has a planar bottom plate portion 6 whose bottom surface area is large enough to distribute the load of the steel column member 1 to the concrete foundation 2 at a stress which is below an allowable limit to the concrete member of the foundation 2 through the interface between the base plate member and the concrete foundation. A projection 7 is integrally formed with the planar bottom portion 6 so as to form a top surface 7*a* and 7*b* whose shape is substantially identical to the cross section of the H-shaped steel column member 1, said top surface of web 7*b* of projection having a broader width than that of web 1*b* of the steel column member 1, and a J-shaped groove 5 formed along the edges of top surface 7*a* of projection, the width of which groove 5 is substantially identical to the bottom surface of flange of the steel column member so as to effect groove welding between the grooved surface of projection and the bottom surface of the flange of steel column member, and a residual top surface 7*a* of projection extending inwardly toward web from the edge thereof, so as to effect the fillet welding between said top surface 7*a* of base plate and the lower end of flanges of column member 1.

Referring to FIG. 1, the height H of the projection 7 is determined on the basis of the ease of welding the column member 1 to the top surface 7*a* and 7*b* and the suppression of the welding strain or bending of the base plate member 20 due to the welding of the column member 1 thereto.

Smoothly curved surface portions 8 are formed where the projection 7 rises from the planar portion 6, so as to eliminate any stress concentration in the base plate member 20 due to the presence of sharp corners. Thus, the radius of curvature of the curved surface 8 must be chosen on the basis of effective suppression of the stress concentration. Whereby, the smooth transfer of the load of the column member 1 toward the concrete foundation 2 is ensured.

The planar portion 6 has a sloped or tapered top surface 6*a*, so that the thickness of the planar portion 6 increases as it extends toward the projection 7. With such sloped top surface 6*a*, the thickness of the planar portion 6 is increased at those parts where the stress is high, while allowing comparatively thin thickness to the less stressed parts thereof. As a result, the rigidity of the projection 7 is enhanced, too. Furthermore, superfluous thickness of the base plate 20 is eliminated.

Abutments 9 are integrally formed at the parts where anchor bolt holes 11 are bored through the base plate member 20. The top surface of the abutment 9 is made parallel to the bottom plane of the planar portion 6, so as to stabilize the contact surface between the nut 17*a* and the abutment 9. It is, of course, possible to insert suitable washers (not shown) between the abutment and the nuts 17*a*. Referring to FIGS. 1 and 2, the width and the thickness d of the abutment 9 are so chosen as to ensure smooth transfer of the load of the column member 1 toward the anchor bolts 17. Suitably curved surfaces 10 are formed at the junction between the abutment 9 and the projection 7, for preventing stress concentration thereat.

The steel column base plate member 20 of the aforesaid construction may be made by casting or by forging.

The steel column member, e.g., the H-shaped steel member, is made by rolling in a universal mill. Accordingly, once its nominal dimension is determined, the inside dimensions and the radii of curvature of the junctions of different inside surface portions are fixed, regardless of the difference in the thickness of flanges and webs thereof. In fact, the shapes and dimensions of the steel column members to be used in architectural buildings and construction structures are selected from a limited number of varieties. Accordingly, it is comparatively easy to provide such top surface 7*a* and 7*b* of the projection 7 which is of substantially identical shape with the sectional shape of the steel column member 1.

According to the present invention, the web part 7*b* of the top surface of the projection facing the lower ends of the web of the column member 1 has a width broader than that of the web so as to effect a fillet welding between the web part 7*b* of the top surface of the projection and the lower end of the web along both sides thereof.

The J-shaped groove 5 is formed along the edges of top surface 7*a* of projection, the width of which groove 5 is substantially identical to or broader than the bottom surface of the flange of the steel column member so as to effect groove welding between the J-shaped grooved surface of projection and the bottom surface of the flange of steel column member and the residual top surface 7*a* of projection extending inwardly toward web from the edge of groove so as to effect the fillet welding between said top surface 7*a* of base plate and the inner lower end of flange of column member 1. The J-shaped welding grooves 5 are formed at the time of casting or forging of the base plate member 20 per se.

The base plate member may be preferably formed with a center line or center lines (not shown) at the time of casting or forging corresponding to scores marked in the column member by a scraper and lines marked in the concrete foundation for facilitating the correct registering of the base plate member 20 relative to the column member and the concrete foundation.

Figure 6:
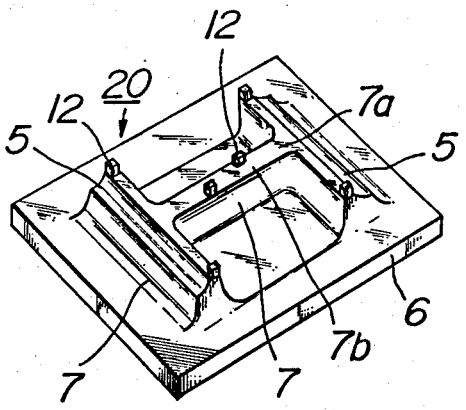
FIG. 6 is a perspective view illustrating a modified base plate of the invention formed with bosses for facilitating the registration of the column member with the base plate member.

To facilitate the correct registering of the steel column member 1 relative to the base plate member 20, suitable bosses 12 may be provided at the top surface 7*a* and 7*b* of the projection as shown in FIG. 6.

Figure 3:
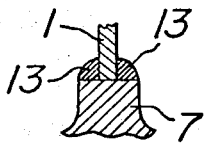
FIGS. 3 and 4 are schematic partial sectional views, illustrating the manner in which an H-shaped column member is welded to the base plate member of the invention.
Figure 4:
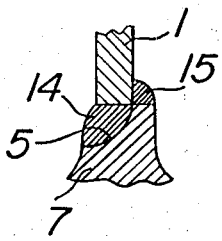
Figure 5:
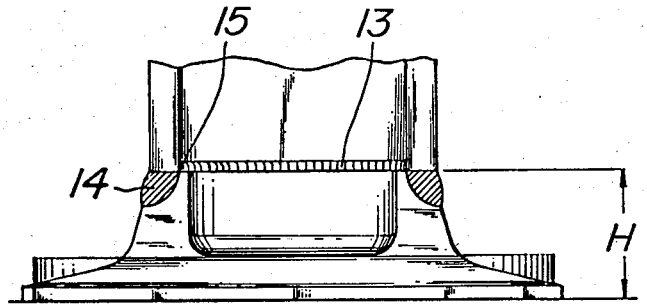
FIG. 5 is a schematic sectional view showing J-shaped groove and fillet welded beads for connecting the column member to the base plate member according to the invention.

In actual construction, fillet welding is performed along the top surface 7*b* on both sides of the web of the column member to form fillet welding beads 13 as shown in FIGS. 3 and 5 and J-shaped groove welding or butt welding is performed along the J-shaped grooves 5 with the flanges of the H-shaped column member 1 to form groove welding beads 14 as shown in FIGS. 4 and 5. Before the J-shaped groove welding, the fillet welding may be effected successively along the inner lower end of the flanges and the top surface 7*a* to form fillet welding beads 15 as shown in FIGS. 4 and 5 which serve to increase strength of the welded portions and as sealing beads for the subsequent J-shaped groove welding. It is apparent to those skilled in the art that the use of bosses 12, as shown in FIG. 6, will facilitate the registration or indexing of the column member 1 with the base plate member 20.

In using the base plate member 20 according to the present invention for a construction, the top surface 7*a* and 7*b* of projection of base plate is brought into contact with the lower end of an H-shaped column member 1 with the aid of the center lines of the plate member in registry with the scores of the column member. Tack welding is effected at several locations between the column member and the base plate member, for example, two points at the web of the column member and four points at the inner lower end of the flanges of the column member for fixing a relative position therebetween to facilitate the subsequent welding. Then fillet welding is performed along on both sides of the web of the column member to form the bead 13. Fillet welding is preferably effected successively along the inner lower ends of the flanges of the column member to form beads 15 which serve to provide an additional reinforcement for the flange portion and prevent the J-shaped groove weld bead 14 from dropping over. The beads 15 serve additionally to minimize of shrinkage of the member after the prosecution of welding in conjunction with the metallic touch of the top surface of the base plate member with the lower end of the column. The beads 15 often extend through a clearance between the flange and the top surface 7*a* into a space of the J-grooves. Such an excess bead extending into the groove 5 is then gouged or removed. Then, J-shaped groove welding or butt welding is effected to form beads 14 between the flanges of the column member and the protrusion 7.

The column member and the base plate member thus united are brought onto a concrete foundation such that anchor bolts 17 extending from the foundation pass through the anchor bolt holes 11 and the center lines of the base plate member are in registry with the lines marked in the concrete foundation. The nuts 17*a* are threadedly engaged with the anchor bolts 17 and then tightened with a determined amount of torque by means of a suitable equipment such as a constant torque wrench.

The base plate member for the H-shaped column member according to the present invention has following characteristics distinguishable over those in the prior art.

Figure 7:
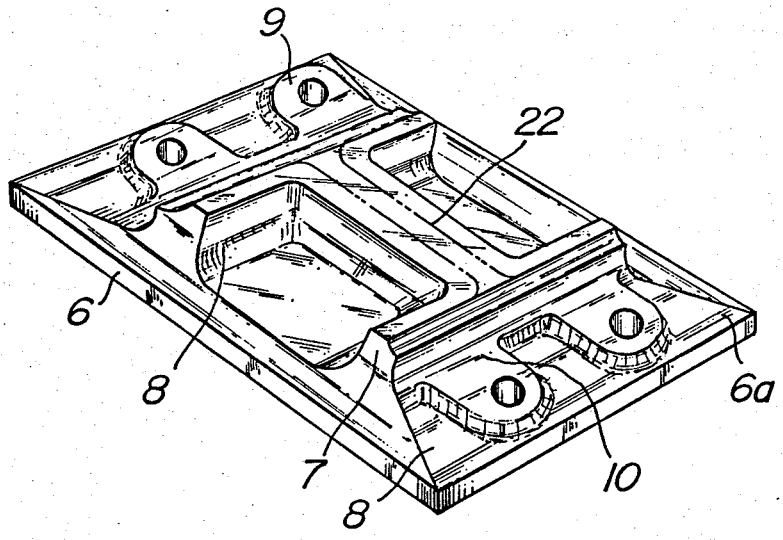
FIG. 7 is a perspective view of the base plate member according to the invention explanatorily illustrating the configuration of the base plate member.

(1) Outer configuration:

The base plate member according to the present invention has the configuration as shown in FIGS. 1, 2 and 7. There are smoothly curved surface portions 8 at the junctions between the projection 7 and the sloped top surface 6*a* and further smoothly curved surface portions at the junctions 10 between the abutments 9 and the planar bottom portion 6. These smooth surfaces prevent any stress concentration and serve to transmit smoothly the load from the column member to the concrete foundation.

The area shown in chain lines 22 in FIG. 7 illustrates the contact surface in contact with the bottom of the column member which provides a metal contact which serves to keep an accuracy of the height of the column member and makes it easy to set the column member on the concrete foundation.

The J-shaped grooves for butt welding are integrally formed in the base plate in casting or forging so that the forming of the J-shaped grooves scarcely increases the cost of the base plate and the column member is not required to have any worked portion for butt welding. Accordingly, the working of column members will be simplified to save time and cost for manufacturing the construction.

(2) The combination of fillet and butt weldings:

It has been known that shearing strengths of fillet and butt welded portions at their throats are substantially equal to each other, while the tensile strength of the butt welded portion is generally higher than that of the fillet welded portion. The present invention utilizes these characteristics in strength to enable the base plate to support a load in the most effective manner.

Figure 8:
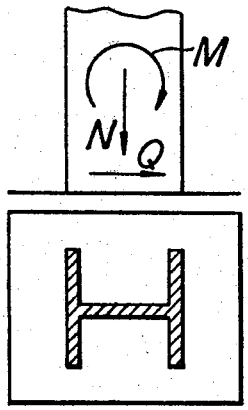
FIG. 8 is a diagrammatical view showing an axial force, a bending moment and a shearing force acting upon an H-shaped column member and a relationship between these forces and flanges and a web of the column member.

In general, a column is simultaneously subjected to an axial force N, a bending moment M and a shearing force Q as shown in FIG. 8 which diagrammatically shows the axial force, the bending moment and the shearing force acting upon the column member. An H-shaped column member is generally so arranged that the flanges of the column member will receive the bending moment M and the web will receive the shearing force Q. Accordingly, the welded portions of the flanges will be subjected to tensile forces and the welded portions of the web will be subjected to a shearing force. By welding the flange by the butt welding and the web by the fillet welding the most effective welding arrangement can be accomplished which beneficially meets stresses derived from the forces and moments to which the column member is subjected. The base plate member according to the present invention has a configuration suitable to carry out the above the combination of fillet and butt weldings. In more detail, the base plate member comprises the H-shaped top surface *7a* and *7b* whose shape is substantially identical to cross sectional shape of the steel column member, a top surface *7b* of projection in opposition to the web of the column member having a broader width than that of web of column member sufficient to effect fillet welding between the web of the column member and the top surface *7b*, and J-shaped welding grooves 5 formed along the edges of the top surfaces *7a* in opposition to the flanges of the column member for J-groove welding with it.

The fillet welding at the web may be effected in succession along the inner lower end of the flanges and the top surface *7a* to form the fillet welding beads 15 which serve to prevent the J-shaped groove weld from droppings during the course of welding and provide an additional reinforcement for the web portion.

Figure 9:
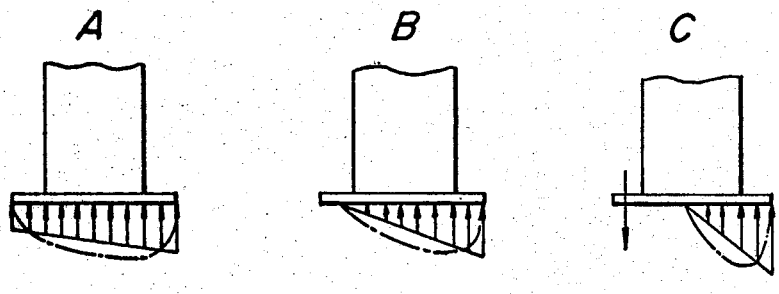
FIG. 9 illustrates various reaction distributions depending upon the relation between bending moments and compressive forces.

(3) Dynamics on the base plate:

The column member is subjected to the axial force N, the bending moment M and the shearing force Q which act between the base plate and the concrete foundation as shown in FIG. 8. Depending upon the magnitude of these forces and their combination, a reaction force between the base plate and the foundation varies in distribution and amount as shown in FIG. 9. FIG. 9A shows the reaction force in case of the bending moment is relatively small in comparison with the compressive force, FIG. 9B is in case of the bending moment is normal or intermediate and FIG. 9C is in case of the moment is a great value. In any case, these compressive force, bending moment and shearing force simultaneously act upon the column member, so that reaction forces are caused between the base plate member and the column member as shown in arrows in FIG. 9 wherein solid lines of the arrows show theoretical distribution of the reactions and dot-and-dash lines show actual distributions. In case of FIG. 9C, due to the great moment, one flange of the column member tends to raise to cause a great tensile force in anchor bolts.

When the base plate member is subjected to a great contact force in an axial direction of the column member which causes a bending action (a positive bending moment) on the plate member, so that the plate member is required to have sufficient yield strength and rigidity to resist to the bending action.

When the anchor bolts are subjected to a great tensile force as shown in FIG. 9C, a great reaction force is caused in the proximity of the holes for the bolts formed in the base plate and results in a bending action (a negative bending moment) on the plate member, so that the member is required to have sufficient yield strength and rigidity to resist to the action.

The bending moment and the shearing force generally act on the base plate member as alternate stresses. Accordingly, the base plate member is generally required to have a symmetrical yield strength and rigidity. The yield strength will resist to the stress so as not to be broken and the rigidity will resist to the stress so as to restrain a deformation.

At any rate, when the base plate member is subjected to reaction forces as shown in FIGS. 9A, 9B and 9C, the base plate will be subjected to a bending action of which bending stress is maximum at the place on the base plate member in opposition to the flanges and web of the column member.

Accordingly, the feature of the projection 7 of the base plate projecting from the base portion and corresponding to the sectional area of the column member and the feature of decreasing the thickness of the bottom plate portion toward the outer ends thereof provided a rational configuration in agreement with the stress distribution. In addition, with the configuration the top surface of the projection to be welded to the lower end of the column member is remote from the base portion of the base plate member so as to be remote from the portions subjected to violent heating for welding, thereby preventing the base portion from deforming in welding. The base plate member having a changing thickness can be advantageously made by casting or forging.

Figure 10A:
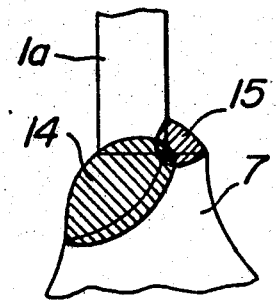
FIG. 10*a* and 10*b* are schematic sectional views of J-shaped groove weld and L-shaped groove weld, respectively.
Figure 10B:
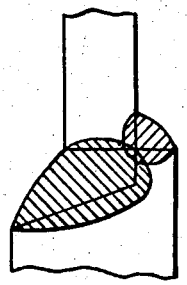

(4) Advantages of J-shaped groove welding:

An amount of weld metal or deposited metal in the J-shaped welding is less than those in any other welding methods for the same purpose. The reliability in penetration or weld penetration in the proximity of the root of J-shaped groove weld is higher than those in any other methods and also higher than that in L-shaped groove weld as shown in FIG. 10b. The J-shaped groove welding operation can be carried out with ease. In spite of these advantages, the J-shaped groove welding requires to form J-shaped grooves which are apt to increase the cost of welding. According to the invention by casting and forging the base plate member, J-shaped grooves can easily be formed in the base plate member, so that the base plate member can utilize the advantages of the J-shaped groove welding without increasing cost for providing the J-shaped grooves.

(5) Cost comparison:

We compared the cost of the cast steel base plate members according to the invention with that of the prior art steel base plates for H-shaped column members 450 (web) × 300 (flange) mm. One example of the comparison is indicated in Table I.

Table I

| | | Unit price | Cast steel base plate (Present invention) Total weight | Total cost | Steel base plate (Prior art) Total weight | Total cost |
|---|---|---|---|---|---|---|
| Material cost | Casting | $0.605/lb (Y400/kg) | 430 lbs (195 kgs) | $260 (Y78,000) | 0 | 0 |
| | Steel plate | $0.151/lb (Y100/kg) | 0 | 0 | 1,043 lbs (473 kgs) | $158 (Y47,300) |
| | Welding rod | $0.423/lb (Y280/kg) | 0 | 0 | 132 lbs (60 kgs) | $56 (Y16,800) |
| | | Total | 430 lbs (195 kgs) | $260 (Y78,000) | 1,175 lbs (533 kgs) | $214 (Y64,100) |
| Working cost | Labor cost | $33.3/man (Y10,000/man) | 0 | 0 | 3.97 men | $199 (Y59,595) |
| | Indirect cost | $16.7/man (Y5,000/man) | | | | |
| | Total | | $260 (Y78,000) | | $412.3 (Y123,695) | |
| | Economical Comparison | | 63% | | 100% | |

A number of cast steel base plates of totally 430 lbs according to the invention were used in the comparison, which only require casting operation but not require any other operation such as working or welding operation for providing the base plates themselves. Accordingly, the total cost was $260. In contrast herewith the steel base plates of the prior art require the steel plates of 1,043 lbs and welding rods of 132 lbs for providing the number of the base plates equal to the above cast steel plates and further require the working operation with direct and indirect costs, so that the total cost was $412.3. The cost of the cast steel base plate according to the invention is only 63% of that of the welded steel base plate of the prior art.

As can be seen from the above description, the base plate member according to the invention has a various of novel features of the configuration making it possible to effect a combination of fillet and butt welding to meet the stress condition acting upon the column member and the base plate; preventing the base portion from deforming in welding by arranging the welding portion on the top of the protrusion remote from the base portion; having an effective sectional shape to meet the bending stress distribution; and making it possible to effect the effective J-shaped groove welding.

It is understood by those skilled in the art that the foregoing description is a preferred embodiment of the disclosed base plate and that various changes and modifications may be made in the invention without departing from the spirit and scope thereof.

What is claimed is:

1. A method of connecting an H-shaped steel column member to a base plate member, wherein said base plate member comprises a substantially planar bottom plate portion, a projection extending from the planar bottom plate portion and having a top surface whose shape is substantially identical to cross sectional shape of the steel column member, a web part of a top surface of said projection having a width broader than that of a web of column member, J-shaped welding grooves formed along both edges of said top surface of said projection facing to lower ends of flanges of said column member, the improvement characterized by, the steps of placing the lower end surface of said column member onto said top surface of said base plate member in a desired relation, effecting fillet welding along between lower ends of said web of the column member and said top surface of said base plate member, and effecting J-shaped groove welding along said J-shaped grooves of said base plate member between bottom surfaces of said flanges of the column member and said grooved surfaces of said base plate member.

2. A method according to claim 1, wherein a fillet welding is effected along between the inner lower ends of said flanges of the column member and said top surface of base plate member.

3. A method according to claim 1, wherein a tack welding is effected between said column and said base plate member for temporarily fixing a relative position therebetween for the subsequent welding operation, before effecting said fillet welding along said web of column member.

* * * * *